US005383238A

United States Patent [19]

Morris

[11] Patent Number: 5,383,238

[45] Date of Patent: Jan. 24, 1995

[54] INDEPENDENT LIFT

[76] Inventor: Edward J. Morris, 302 Erie, Bay City, Mich. 48607

[21] Appl. No.: 210,626

[22] Filed: Mar. 18, 1994

[51] Int. Cl.[6] ..... E04H 4/14; A47K 3/12

[52] U.S. Cl. ..... 4/496; 4/562.1; 5/87.1

[58] Field of Search ..... 4/496, 560.1, 561.1, 4/562.1, 563.1, 564.1, 565.1, 566.1; 5/83.1, 87.1, 89.1

[56] References Cited

U.S. PATENT DOCUMENTS

| | | | |
|---|---|---|---|
| 3,104,399 | 9/1963 | Dalton | 4/562.1 |
| 3,852,835 | 12/1974 | Whitaker | 4/562.1 |
| 4,183,106 | 1/1980 | Grimes et al. | 4/496 |
| 4,221,008 | 9/1980 | Nolan | 4/496 |
| 4,283,803 | 8/1981 | Krumbeck | 4/496 |
| 4,606,082 | 8/1986 | Kuhlman | 4/561.1 |
| 4,928,330 | 5/1990 | Moore | 4/562.1 |
| 4,996,728 | 3/1991 | Nolan | 4/496 |
| 5,129,112 | 7/1992 | Schaffer | 4/560.1 |
| 5,218,727 | 6/1993 | Krumbeck | 4/563.1 |

*Primary Examiner*—Robert M. Fetsuga
*Attorney, Agent, or Firm*—Robert L. McKeller

[57] ABSTRACT

This invention deals with a motorized device which allows independent movement into and out of a pool of water, which device may or may not be under the control of the invalid or handicapped person. The device comprises a motorized pair of arms which carry a bar, which bar has mounted on it, a carrier for a person. The device, in spite of a high movement of the bar overhead, allows for the transportation of the person through essentially a horizontal plane.

6 Claims, 4 Drawing Sheets

FIG. 1
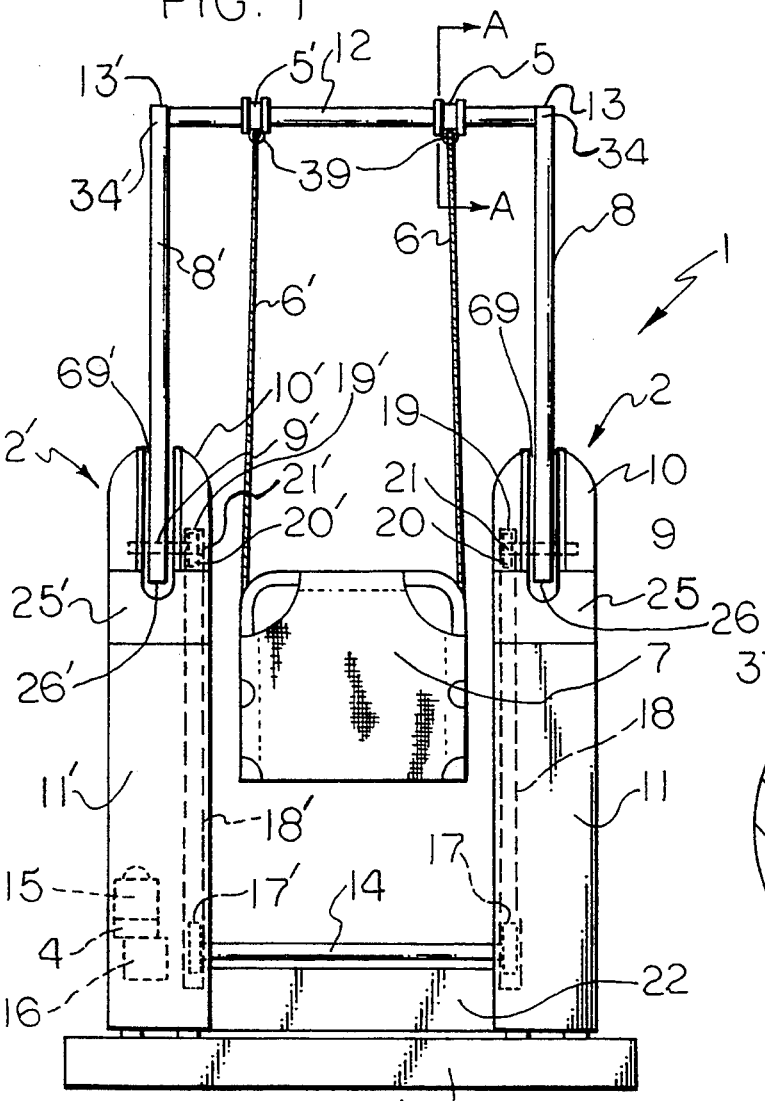
FIG. 3
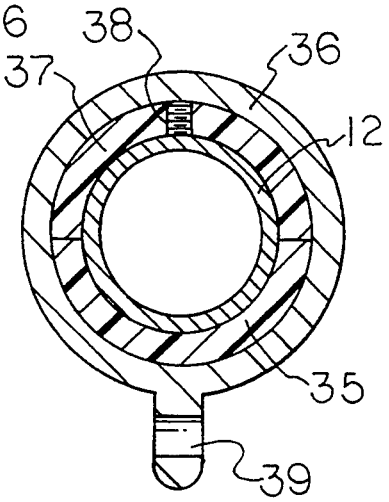
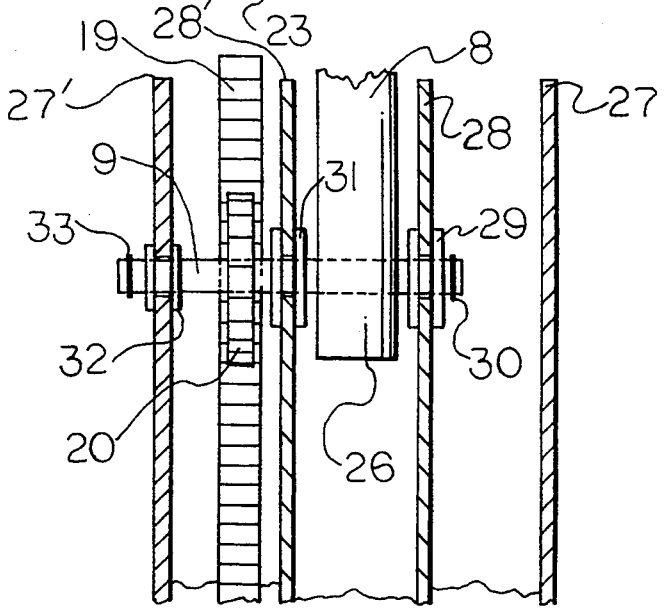
FIG. 2

FIG. 4
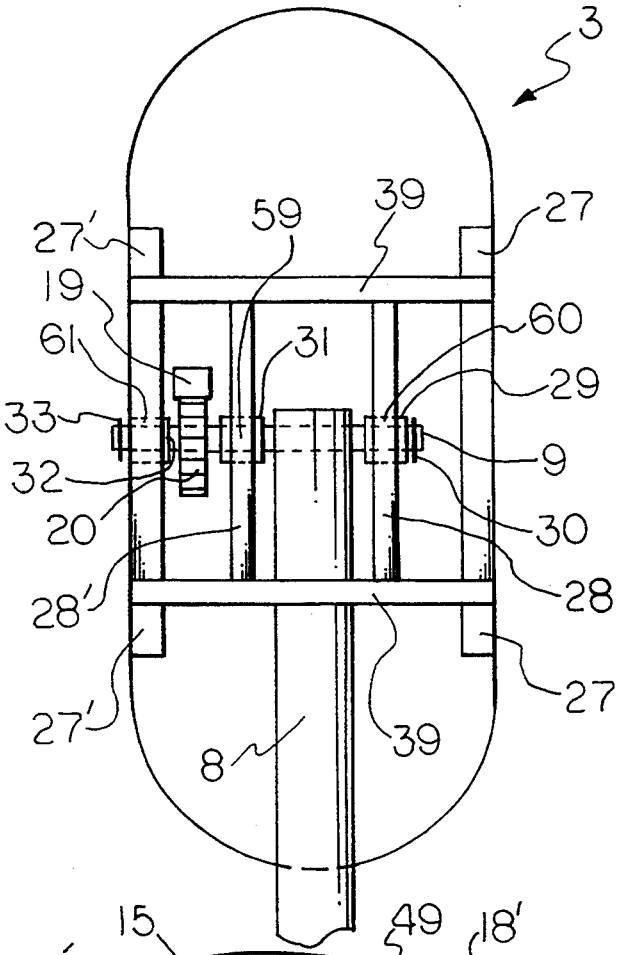
FIG. 8
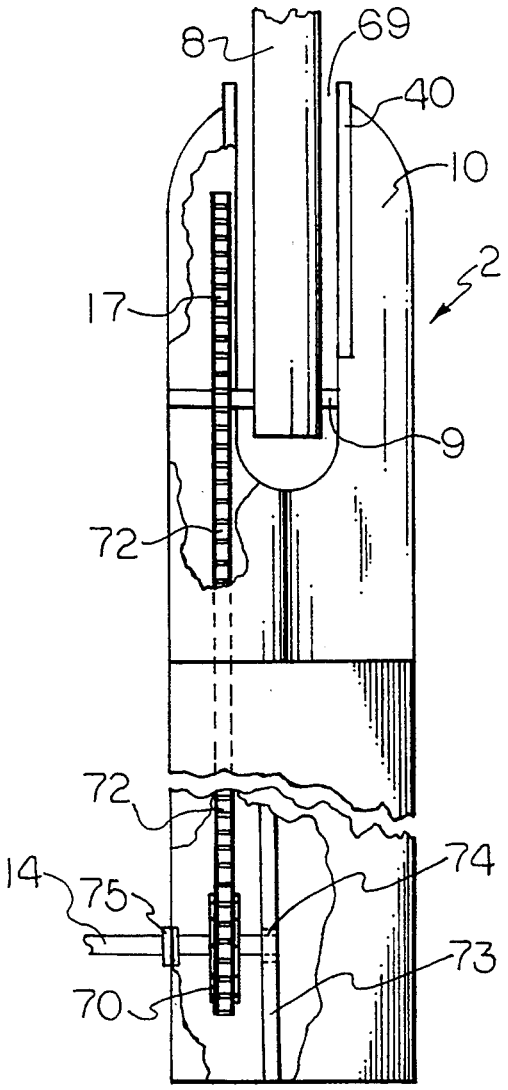
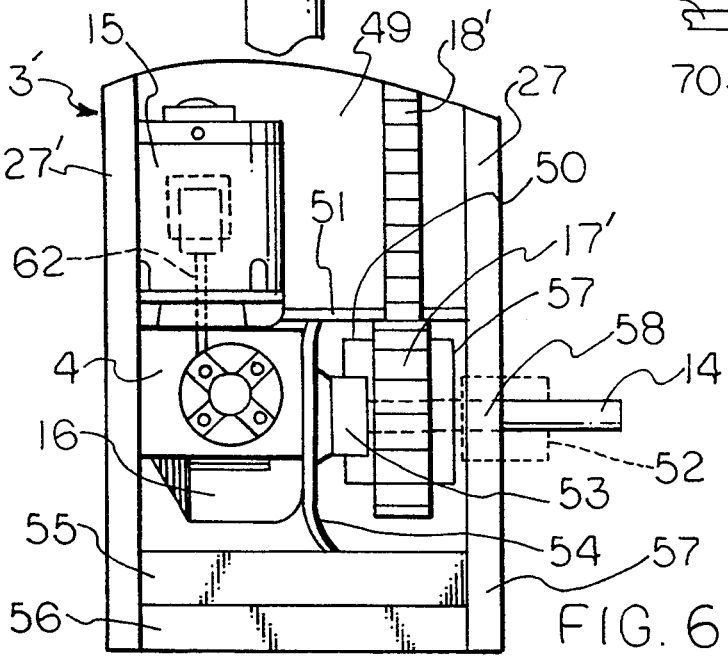
FIG. 6

INDEPENDENT LIFT

The invention disclosed and claimed herein deals with a device for moving an invalid or handicapped person from a poolside into a pool, and back to the poolside, wherein the invalid or handicapped person may be responsible for the total movement without the aid of a second person.

More specifically, this invention deals with a motorized device which allows independent movement into and out of a pool of water, which device may or may not be under the control of the invalid or handicapped person, and a device in which there is enhanced security for the invalid or handicapped person from falling, or slipping from the support of the device, or being immersed in the pool water for a time longer than desired, or for a depth that is not desired, or from being moved to dangerous heights above the poolside in order to accommodate the movements of the device, and which allows for the mounting of the device from the back of the device which is away from the edge of the pool, and which provides a barrier to accidental slippage into the pool.

The device of this invention requires that the support platform for the invalid or handicapped person be the only part immersed in the pool water, and thus, no working parts of the device are in the water, and thus the device does not deteriorate as quickly. Further, there is only a slight vertical lift, with a longer horizontal movement, which allows the user to be moved in essentially a horizontal movement, and which allows for the support platform of the lift to be loaded well away from the edge of the pool, and essentially behind it.

Further, the device of the instant invention allows for more than adequate freedom of motion of the user in the pool, and finally, there are no hydraulics to worry about with regard to maintenance and potential environmental problems.

Thus, it is one object of this invention to provide a device which can be operated by the person deriving the benefits of the device, without the intervention or help of a second party.

It is a further object of this invention to provide a device that will move an invalid or handicapped person from the poolside into a pool, immerse the invalid or handicapped person to a desirable depth in the pool water, and then safely move the invalid or handicapped person back to the poolside, all in relative safety.

It is a still a further object of this invention to provide a device in which there is freedom of movement by the user once the user is immersed in the pool water.

It is yet another object of this invention to provide a device that has low maintenance, will not provide potential problems with the environment through the use and disposal of hydraulic fluids, and which will allow a handicapped or invalid person to utilize in relative safety because of loading of the support device from the back of the independent lift.

BACKGROUND OF THE INVENTION

A variety of lift devices are known in the prior art for moving invalid or handicapped persons from one position to another. In fact, there are several devices disclosed in the prior art which have been found useful specifically for moving persons from the poolside to the pool and back again, or movement to and from a bathtub and the like.

Such devices suffer from flaws in operation, safety, or convenience and the inventor herein, familiar with such devices as a result of having worked in the field for several years, noted these flaws and devised an apparatus which tends to overcome most, if not all, of such shortcomings.

One such device of the prior art can be found in U.S. Pat. No. 4,606,082, issued on Aug. 19, 1986 to Kuhlman. Kuhlman discloses a lift apparatus for transferring a person of limited mobility to and from a restricted area such as a raised tub-like water treating facility, and in particular such an apparatus which is particularly adapted for transfer from and to a wheelchair without requirement of the individual standing during the transfer process. It is noted that this device requires an overhead support system, which would not tend to be accommodating to a poolside.

A second device which is useful in bathtubs and the like is disclosed by Schaffer in U.S. Pat. No. 5,129,112, which issued on Jul. 14, 1992. This device is attachable to the side walls of a bathtub enclosure. It does provide for an operator device which can be controlled by the user of the device. However, this device would not be useful at the poolside for two reasons, namely, it needs sidewall support, and it does not move the loading operation far enough from the edge of the pool as does the device of the instant invention.

Grimes, et al, in U.S. Pat. No. 4,183,106, issued Jan. 15, 1980, discloses a motorized lift that supports a chair at the side of a pool in a position to receive a handicapped person as shown in FIG. 1. The chair is rotated out over the water, as indicated by the directional arrows in FIG. 1, and is then lowered into the water, whereupon the occupant slides or pushes off the chair for swimming or a therapy session. The chair is adapted to receive the person after the session, and is then raised out of the water, and rotated back to the initial pool side position, so that the person can leave the chair with a minimal amount of difficulty. This device has as its shortcomings, the inability of providing the loading of the user away from the edge of the pool, and, the user must have a second person manipulate the controls.

A third device is that disclosed in Nolan, U.S. Pat. No. 4,221,008, which issued Sep. 9, 1980, which discloses a swimming pool chair lift wherein a patient may be transported vertically, in a helical pattern, into and out of a pool of water or similar liquid. The chair lift includes an L-shaped seat 6, hydraulic cylinder means 8 adapted to receive the seat, and is activated by a particular fluid at a selected pressure. Guide means, such as cam 12 and follower 11, follow a helical path as the cylinder is moved vertically along the cam into, and out of, the pool of the liquid. The carrier can thus be lowered, or raised, out of the pool, while being rotated through an arc that enables the disabled person to be transported to a stable pool side position. This device has the shortcoming that it uses a hydraulic system to power the seat and apparatus. Further, it has the disadvantage of not being able to be mounted a fair distance from the side of the pool.

A second Nolan patent is U.S. Pat. No. 4,996,728, which issued Mar. 5, 1991, and which deals with portable lift structures much like that disclosed in the '008 patent, except that the hydraulic means is separated from the support means such that the descent and ascent is not exactly vertical. This device suffers from the same defects as the first Nolan device, in that, it uses a hydraulic system and it has to be mounted adjacent the pool edge.

The device of the instant invention overcomes some or all of the problems associated with the prior art devices.

THE INVENTION

The invention herein deals with a motorized independent lift comprising two spaced apart, vertical columns, each vertical column having a top end and a bottom end, and a front and a back, and each vertical column being capable of being secured by its bottom end to a solid substrate and each vertical column being comprised of at least four vertical posts.

Each vertical column contains braces and support plates therein to at least stabilize and brace the vertical support posts to each other, in a spaced-apart relationship. At least one pair of such support plates is located near the top end of each vertical column, and at least one pair of such support plates is located near the bottom end of each vertical column. The vertical columns are detachedly braced to each other at their bottom ends by a common brace.

There are two independent lifting arms, and each said lifting arm has a near end and a distal end and each lifting arm is fixedly attached to a first rotatable shaft, wherein the first rotatable shaft has an outer end and an inner end, and is supported by, and rotatably locked into respective bearings on each of its outer and inner ends. The bearings are located in openings in the top support plates, and are supported by the top support plates, wherein all of the openings in the top support plates, the first rotatable shafts, and the bearings of both lifting arms, are horizontally aligned from one column to the other. Each lifting arm is detachedly secured near its distal end by a lifting bar common to both lifting arms, to form an inverted U-shaped assembly comprised of the lifting arms and the lifting bar.

The inner ends of each shaft are surmounted by a first pinion gear. Each first pinion gear is movably integrated with a rack to provide vertical rectilinear motion from vertical reciprocating motion. Each of the racks are movable, elongated shafts having an upper end and a lower end, and are slidably mounted in channel bearings. The channel bearings are in turn, mounted to a support of the vertical column, and each rack has physical contact at its upper end with its respective first pinion gear.

Each rack is movably integrated with a second pinion gear at its lower end, wherein each second pinion gear is fixedly surmounted on a common shaft. The common shaft has a drive end and a follow end, and is located in the bottom end of the vertical column and is supported by bearings on each of its drive end and follow end. The bearings are located and supported in openings in the bottom support plates, and, the openings in the bottom support plates, the bearings in the bottom support plates, and the common shaft are horizontally aligned from one column to the other. The following end of the common shaft is rotatably locked into its respective bearing and the driving end of the common shaft is integrally locked to a transmission located adjacent the common shaft, and being driven by said transmission, which transmission is driven by gears located in a gear box adjacent the transmission, the gear box being driven by a third shaft, which third shaft is driven by a power source, which power source is controlled by a control device mounted on the independent lift near the user.

There is a support device for supporting a human form, wherein the support is attached to the lifting bar by two, independent attachment means, wherein each attachment means is spaced apart along the lifting bar and is comprised of (i), a coupling having bushings situated therein, wherein each coupling and bushing surrounds and rotates around the lifting bar, and (ii), a suspension means, attached to, and extending from each coupling and attached to the support device so as to support, stabilize, and balance the support device.

Each vertical column has a covering which is comprised of a top segment, having an upper surface, and a bottom segment having a top end, each said covering essentially encloses a vertical column. The top segment is essentially surmounted on the top end of the bottom segment and the top segment of each covering has a slot through its upper surface to accommodate a reciprocal movement of each lifting arm therethrough, from the front to the back and from the back to the front of each column. The reciprocal movement of the lifting arms is free movement through an overhead arc which carries the lifting arms in each direction, to end at least below a horizontal plane formed by the horizontal alignment of the first rotatable shafts.

Each of the slots has inside edges and a groove on its inside edges to accommodate a sliding panel, which sliding panel is a flexible sheet, having a length sufficient to cover the slot in the top of the top segment as the arms travel through the arc from the front to the back and from the back to the front of the lift. Each sliding panel has an opening near its center to accommodate a lifting arm therethrough, whereby, as each lifting arm is moved, each respective sliding panel is moved in relation thereto, without allowing the slot to be open at anytime, thus creating a safety shield from the entire internal moving mechanism of the lift.

Each said bottom segment is covered by an outward side panel, an inward side panel, a front panel and a back panel, all of which panels are rigidly fixed to the vertical support posts.

BRIEF DESCRIPTION OF THE DRAWINGS

FIG. 1 is a full back view of the lift of this invention, showing a right vertical column and a left vertical column with the sliding panels removed to enable one to view the lifting arms and associated mechanisms.

FIG. 2 is a back view of the upper part of the right vertical column, with the back panel, U-plate, and back support plate removed to show the rack and pinion and first supporting shaft.

FIG. 3 is a cross-sectional view of a coupling on the lifting bar through the line A—A, with only the upper half of the collar 37 shown.

FIG. 4 is a full top view of the right vertical column with the top segment 10 of the housing removed.

FIG. 6 is an enlarged full view of the lower end of the left vertical column, showing a possible arrangement of the motor, gear box, transmission, coupling, and common drive shaft, with the bottom support plate, and the back covering removed for clarity.

FIG. 8 is a broken, partial back view of the right vertical column, showing the mechanism using a chain drive and sprocket mechanism.

DETAILED DESCRIPTION OF THE INVENTION

Figure 5:
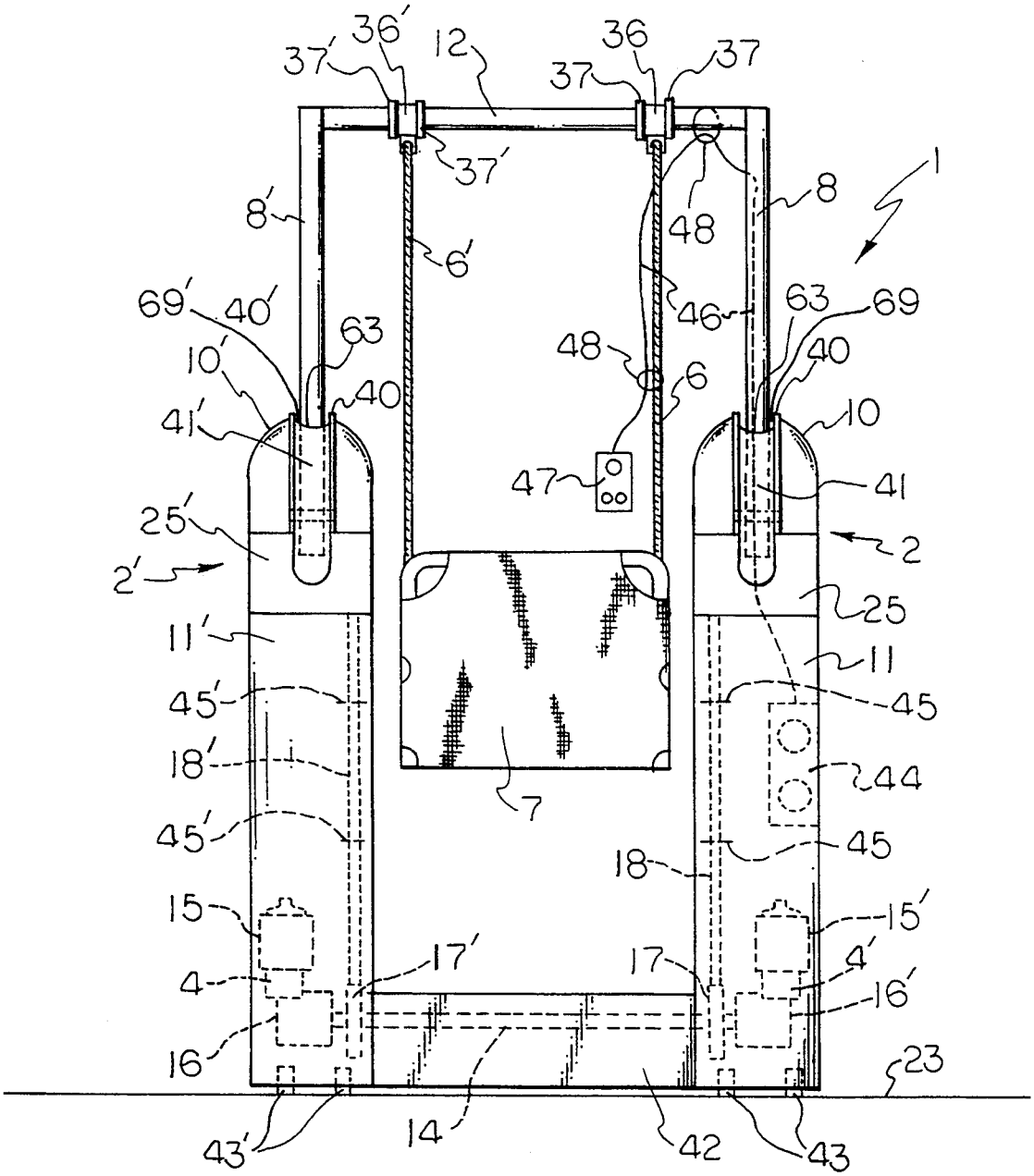
FIG. 5 is a full back view of the lift of this invention showing the lift mounted on a solid substrate, the sliding panels 41, and the internal mechanism in phantom.

With reference to FIG. 1, there is shown a full back view of the independent lift 1 of this invention in which there is shown two essentially identical housings 2 and 2' within which are housed essentially identical vertical columns 3 and 3', (not shown in FIGS. 4 and 1, but are shown in FIG. 6). Also shown are couplings 5 and 5', suspension means 6 and 6', the coupling 5 and suspension means 6 constituting one attachment means to a support platform 7, which is shown in the form of a fabric, aluminum supported, chair structure, and the coupling 5' and suspension means 6' constituting one other attachment means for the support platform 7.

Further shown in FIG. 1, are essentially identical lifting arms 8 and 8', a first supporting, rotating shaft for each, 9 and 9', (which is more visible in FIGS. 2 and 6), top segments 10 and 10', bottom segments including back panels 11 and 11' of the housing 2 and 2', respectively, a lifting bar 12, which joins the lifting arms 8 and 8' at their ends 13 and 13', distal from the vertical columns 3 and 3', respectively There is additionally shown a common drive shaft 14, a detachable cross brace 22 for the vertical columns, a means of securing the vertical columns 3 and 3' to a solid substrate 23, and in phantom, motor 15, transmission 16, second pinion gears 17 and 17', racks 18 and 18' associated with the second pinion gears 17 and 17', and at the upper end 19 and 19', respectively, a first pinion gear 20 and 20', mounted near the inner end 21 and 21' of the first supporting, rotating, shafts 9 and 9', respectively.

Finally, shown in FIG. 1 are the back panels, 11 and 11' which cover the vertical columns 3 and 3', respectively, on the back side of the lift 1, and the U-panels 25 and 25', which form the top part of the back panels 11 and 11', respectively. The portions of the housing located above the U-panels 25 and 25', and surmounting the vertical columns 3 and 3', respectively, are the top segments of the housing 10 and 10', as mentioned above With more specificity, and with regard to the near ends 26 and 26' of the lifting arms 8 and 8', respectively, there is shown in FIG. 2, an enlargement of the right-hand, top of the vertical column 3 of FIG. 1, with the U-panel 25 removed to show vertical posts 27 and 27', interior supporting plates 28 and 28', the near end 26, of lifting arm 8, the first supporting, rotatable shaft 9, outside bearing 29, ring clip 30, first pinion gear 20, inside bearing 31, inside external bearing 32, ring clip 33, and rack 19.

With regard to FIGS. 1 and 2, it can be observed that the combination of the lifting arms 8 and 8', and the lifting bar 12 form an inverted U-shaped configuration. The lifting bar 12 is securely fastened by its ends 34 and 34', to the ends 13 and 13', respectively. This connection is preferably one in which the lifting bar 12 is fastened to the lifting arms by a socket screw threaded through both parts. Thus, it can be appreciated that such a configuration will not allow the lifting bar 12 to accidentally loosen from either of the lifting arms 8 or 8', but that lifting arm 8, or 8', can be separated and removed for servicing, maintenance or the like, if desired.

The couplings shown at 5 and 5', are configured to rotate around the lifting bar 12, but remain essentially spaced apart from each other. This is accomplished as shown in FIG. 3, by providing a bushing 35, which is fitted to the lifting bar 12 such that it rotates around the lifting bar 12. The bushing 35 is over-fitted with a collar 36, in which is provided a ring or hook 39. The bushing 35 and the collar 36 are prevented from moving along the lifting bar 12 by a set of collars 37 and 37', which are tightly clamped to the lifting bar 12 by, for example, a series of set screws 38. It can be appreciated that the collars can be loosened and adjusted along the lifting bar 12 to accommodate usage.

FIG. 4 is a top view of the partial device of FIG. 2, wherein there is shown the rack 19, the first pinion gear 20, the bearing 31, located in opening 59, the support plates 28 and 28', ring clip 33, bearing 32, located in opening 61, lifting arm 8, first supporting, rotating shaft 9, vertical posts 27 and 27', brace plates 39, bearing 29, located in opening 60, and ring clip 30.

It should be noted by those skilled in the art that the vertical columns 3 and 3', with all of the vertical posts 27, and 27', along with all of the supporting plates and braces, can be fixed together by any suitable means which will provide a solid structure, such as, for example, welding, bolting, clipping, or clamping, and the like.

Turning now to FIG. 5, which is a full back view of the independent lift 1 of this invention, wherein there is shown the device with the housing 2 intact, with the internal working parts shown essentially in the openings in the housing 2. Thus, there is shown the lifting bar 12, the lifting arms 8 and 8', the attachment means collars 36, and 36', with retainer collars 37 and 37', the suspension means 6 and 6', the support platform 7, which is a chair, for example, a chair fabricated from nylon fabric over an aluminum support frame, the top segments of the housing 10 and 10' slots 69 and 69', the leading edges 40 and 40' of each slot 69 and 69' (shown on FIG. 8), respectively, the U-panels 25 and 25', the back panels 11 and 11', the sliding panels 41 and 41', a safety shroud or tubing 42 for the common drive shaft 14, electrical cords 46, and fasteners 48 therefor, control box 47, gear boxes 4 and 4', and in phantom, the motors 15 and 15', transmissions 16 and 16', common drive shaft 14, second pinion gears 17 and 17', racks 18 and 18', hold downs for the device, 43 and 43', and electrical box 44 to house electrical components for the device, and collars and clips 45 and 45', which are fitted onto the racks 18 and 18' to actuate limit switches. It should be noted that the inventor herein contemplates that the lift 1 can be constructed such that there is only one motor 15, transmission 16, gear box 4, and a common shaft 14 to drive the internal mechanism of the lift, but also, and preferred by the inventor herein is a dual motor drive mechanism as is illustrated in FIG. 5, wherein there are two motors, 15 and 15', two gear boxes 4 and 4', two transmissions 16 and 16', with one common drive shaft 14 therebetween. Such a configuration allows for a more positive drive for the mechanism, allows for heavier loads to be carried by the lifting bar 12 and the lifting arms 8 and 8', and creates less wear on the moving parts of the mechanism.

Now that it is understood that the lift 1 can be motorized from both sides of the device, attention is directed to FIG. 6, which is an enlarged portion of the vertical column 3', in which the details of the motor 15, the transmission 16, the gear box 4, the working rack 18' and pinion 17', are shown. It should be apparent to those skilled in the art that the same configuration can be installed in the vertical column 3, as well.

Thus, in FIG. 6, there is shown a partial view of the vertical posts 27 and 27', with a view of the back of the front panel 49, rack 18', pinion 17', nylon restraining channel 50, through which the rack 18' slidably moves during operation, support bar 51, common drive shaft 14, bearings 52, transmission coupling 53, brace 54 for the transmission 16, gearbox 4, support bar 55, bottom brace 56, and bottom support plate 57, which is used to stabilize the vertical posts 27, and to hold bearings 52 in opening 58, to support the common drive shaft 14.

Figure 7:
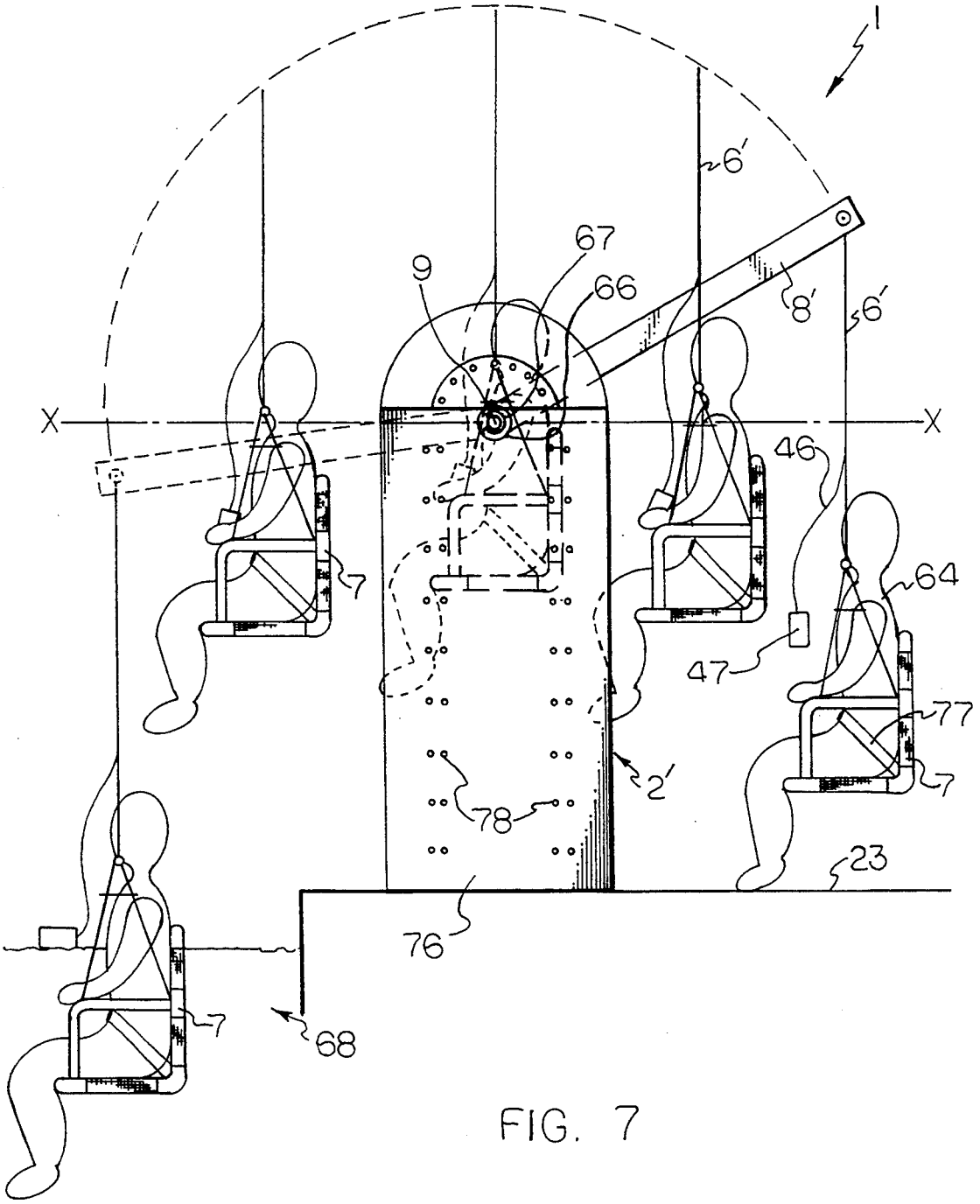
FIG. 7 is a full side view of a complete lift of the invention, showing schematically, the movement of a person using the lift.

Turning now to FIG. 7, in which there is shown a full side view of the lift 1 of this invention, wherein there is shown a person 64, sitting in a support platform 7, which is in the form of a fabric and aluminum chair There is shown the housing 2', which contains a vertical column 3' (shown in FIG. 4 from the top and FIG. 6), and all of the internal working parts described supra. There is shown an outer panel 76, fastened to the vertical posts 27 and 27' (behind the panel 76, and not shown in this Figure) by fasteners 78, it being understood that there is an essentially identical panel 76 forming the inside of the housing, and it is should be further understood that each vertical column 3 and 3', has an essentially identical housing 2 and 2'. Also shown is the lifting arm 8', the suspension means 6', which can be rope, wire, plastic strip, chain, wire cable, or the like, the control box 47, the electrical cord 46, a bearing 66, with a ring clip 67 on a first supporting, rotating shaft 9, a solid substrate 23, which in this illustration is a cement poolside deck.

The FIG. 7 schematically illustrates the movement of the person 64 into and out of a pool 68, wherein the person 64 controls the activity of the lift 1. It should be noted that there is also shown a line X—X, which is a horizontal axis, through the first supporting, rotating shaft 9, and a Z axis, shown at first supporting, rotating shaft 9, moving into the plane of the drawing surface for the Figure. These two axes, form a horizontal plane X, for purposes of illustrating the movement of the U-shaped lifting configuration of the lift 1. The U-shaped lifting configuration, at either end of its intended travel, is required to move down below the X plane, in order to accommodate the loading, movement, and unloading of the invalid or handicapped person, as is illustrated by the phantom lifting arm 8', at the left of the FIG. 7, wherein it is shown that the lifting arm 8' moves past the horizontal X plane and drops below it in order to allow the person 64 to be placed into the pool 68. It should be noted that the activity for loading and unloading the person 64 is carried out well away from the poolside, and utilizes the lift 1 as a barrier against accidental movement towards the pool, preventing the person 64 from falling into the pool. It should be further noted that the line of travel of the person 64, while on the support platform 7 of the lift 1, is nearly horizontal, with just a slight rise above the horizontal level in which the person 64 mounts the support platform 7, thus reducing the potential of the person 64 falling from a great height and causing injury to such person.

In use, the invalid or handicapped person approaches the lift 1 from the back side of the lift 1, and utilizes the control box 47 to bring the support platform 7 to the back of the lift 1, and in a lowered position such that the invalid or handicapped person can move to the support platform 7 and rest therein. Thereafter, a safety belt 77, may be, and should be, brought across the front of the support platform 7 to ensure the safety of the person 64 from falling from the support platform 7. The invalid or handicapped person then controls the movement of the support platform 7 by energizing the motor, and controlling the movement of the support platform 7 as the lifting arms 8 and 8', and the lifting bar 12 move through an overhead arc to advance the supporting platform 7 towards the pool 68, it being understood, that the movement of the support platform 7 and the person 64 is essentially horizontal, in spite of the fact that the lifting bar 12 and the lifting arms 8 and 8', move through a high overhead arc When the support platform 7 has reached the edge of the pool 68, the invalid or handicapped person 64 continues the movement of the support platform 7 so that the lifting arms 8 and 8', and the lifting bar 12 drop down through the X plane, and allow the support platform 7, and the person 64 to be placed into the pool 68. The person 64 can utilize the lift to move into the water in the pool to the desired depth, and because of the flexible suspension means 6 and 6', the person 64 can have freedom of movement in the pool. When finished, the person adjusts the controls to reverse the movement of the lifting bar 12 and the lifting arms 8 and 8', to bring the person 64 back to the poolside.

In operation, when the motor 15 is energized by the person 64, the motor shaft 62 moves the gears in the gear box 4, which in turn operates the transmission 16, which in turns the common drive shaft 14, which in turn simultaneously turns the second pinions 17 and 17' on both sides of the lift 1, which causes the racks 18 and 18' to move simultaneously, which causes the first pinion gears 20 and 20' to move simultaneously, which causes the first supporting, rotating shafts 9 and 9' to turn simultaneously, which causes the lifting arms 8 and 8', and the lifting bar 12 to move simultaneously, to lift and move the supporting platform 7, and any person resting therein. It should be understood by those in the art that the racks are configured such that there are rack ends on each end of a threaded rod. The threaded rod threads into one end of the rack such that the rod threads onto one of the ends with a right hand thread, while the opposite end of the rod threads into a another rack end using left hand threads, such that the ends of the rack can be turned to lengthen or shorten the rack to meet specifications for each device manufactured.

The controls and the motor 15 are capable of reversing, such that the operation described above can be reversed.

As indicated earlier, it is contemplated within the scope of this invention to locate a motor 15, transmission 16, and gear box 4, in each vertical column to co-drive the common shaft 14, or to simultaneously drive independent shafts associated therewith to effect the operation described above.

It is further contemplated within the scope of this invention to use a drive mechanism which is not a rack and pinion, but is, for example, a chain and sprocket mechanism. Thus, with reference to FIG. 8, which illustrates a right side vertical column 3 (not shown) with a view from the back of the lift 1 thereof, there is shown another embodiment of this invention in which there is a small sprocket 70, which has been substituted for the lower pinion gear 17, said sprocket 70 being driven by the common shaft 14. As illustrated, a portion of the housing 2 and the top segment 10 have been removed to help clearly illustrate the invention. Thus, there is further shown lifting arm 8, first supporting, rotating shaft 9, a top segment 10 of the housing 2, the slot 69 for travel of the lifting arm 8, the leading edges 40, large sprocket 71, which has been substituted for the first pinion gear 20, a chain 72, and the bottom supporting plate 73, bearings 74 and 75, and the like which are shown in detail in FIGS. 2 and 4. Those in the art understand that a like mechanical apparatus is also used in the vertical column 3', to drive the lifting arm 8'.

Thus, it will be understood and appreciated that the chain drive mechanism can be essentially substituted for the drive mechanism that is described as the rack and pinion drive supra. It will be further understood and appreciated that this type of drive mechanism can be undertaken by driving one side by a motor using a common drive shaft for both sides as described above for the rack and pinion, or, it can be undertaken by driving a common shaft between two motors, one on each side of the lift 1, or it can be undertaken by driving each side with a motor without a common drive shaft, and driving independent first supporting, rotating shafts 9 and 9' simultaneously.

The inventor has thus described what he believes to be his invention as set forth in the claims below.

I claim:

1. An independent lift comprising:

two spaced apart, vertical columns, each vertical column having a top end and a bottom end, and a front and a back, each vertical column being capable of being secured by its bottom end to a solid substrate and each vertical column comprised of at least four vertical posts;

each vertical column containing braces and support plates therein to at least stabilize and brace the vertical support posts to each other, in a spaced-apart relationship, at least one pair of such support plates being located near the top end of each vertical column, and at least one pair of such support plates being located near the bottom end of each vertical column, said vertical columns being detachedly braced to each other at their bottom ends thereof by a common brace;

two independent lifting arms, each said lifting arm having a near end and a distal end, each said lifting arm being fixedly attached at said near end to a first rotatable shaft, said first rotatable shaft having an outer end and an inner end, and being supported by, and rotatably locked into respective bearings on each of its outer and inner ends, said bearings being located in openings in the top support plates, and being supported by the top support plates, all of the openings in the top support plates, first rotatable shafts, and bearings of both lifting arms, being horizontally aligned from one column to the other, each said lifting arm being detachedly secured near its distal end by a lifting bar common to both lifting arms, to form a U-shaped assembly comprised of the lifting arms and the lifting bar;

the inner ends of each shaft being surmounted by a first pinion gear, in which each first pinion gear is movably integrated with a rack to provide vertical rectilinear motion from vertical reciprocating motion, each said rack being a movable, elongated shaft having an upper end and a lower end, and being slidably mounted in channel bearings, which channel bearings are mounted to the vertical column, and each said rack having physical contact at its upper end with its respective first pinion gear;

each said rack being movably integrated with a second pinion gear at its lower end, each said second pinion gear being fixedly surmounted on a common shaft;

said common shaft having a drive end and a follow end, and being located in the bottom end of the vertical column and being supported by bearings on each of its drive end and follow end, said bearings being located and supported in openings in the bottom support plates, the openings in the bottom support plates, the bearings in the bottom support plates, and the common shaft being horizontally aligned from one column to the other, the following end of the common shaft being rotatably locked into its respective bearing, the driving end of the common shaft being integrally locked to a transmission located adjacent the common shaft, and being driven by said transmission, which transmission is driven by gears located in a gear box adjacent the transmission, the gear box being driven by a third shaft, which third shaft is driven by a power source, which power source is controlled by a control device mounted on the independent lift near the user thereof;

a support device for supporting a human form, said support device being attached to the lifting bar by two, independent attachment means, each said attachment means being spaced apart along the lifting bar and comprised of (i) a coupling having bearings situated therein, each coupling and bearing surrounding and rotatable around the lifting bar, and (ii) a suspension means, attached to, and extending from each coupling and attached to the support device so as to support, stabilize, and balance the support device;

each said vertical column having a covering which is comprised of a top segment, having an upper surface, and a bottom segment having a top end, each said covering essentially enclosing said vertical column, said top segment being surmounted on the top end of the bottom segment;

each top segment of each covering having a slot through its upper surface, to accommodate a reciprocal movement of each lifting arm therethrough, from the front to the back and from the back to the front of each column, said reciprocal movement of the lifting arms being free through an arc which carries the arms at least below a horizontal plane formed by the horizontal alignment of the first rotatable shafts;

each said slot having inside edges and a groove on its inside edges to accommodate a sliding panel, which sliding panel is a flexible sheet, having a length sufficient to cover the slot in the top of the top segment as the arms travel through the arc from the front to the back and from the back to the front; each sliding panel having an opening near its center to accommodate a lifting arm therethrough; whereby, as each lifting arm is moved, each respective sliding panel is moved in relation thereto, without allowing the slot to be open at anytime;

each said bottom segment being covered by an outward side panel, an inward side panel, a front panel and a back panel, all of which panels are rigidly fixed to the vertical support posts.

2. A lift as claimed in claim 1 in which the lift includes a combination of said power source, third shaft, gears, and transmission in each of the vertical columns and which operate simultaneously.

3. A lift as claimed in claim 2, in which the combination in each vertical column simultaneously drives the lift through said common drive shaft communicating between the vertical columns.

4. An independent lift comprising:

two spaced apart, vertical columns, each vertical column having a top end and a bottom end, and a front and a back, each vertical column being capable of being secured by its bottom end to a solid substrate and each vertical column comprised of at least four vertical posts;

each vertical column containing braces and support plates therein to at least stabilize and brace the vertical support posts to each other, in a spaced-apart relationship, at least one pair of such support plates being located near the top end of each vertical column, and at least one pair of such support plates being located near the bottom end of each vertical column, said vertical columns being detachedly braced to each other at their bottom ends thereof by a common brace;

two independent lifting arms, each said lifting arm having a near end and a distal end, each said lifting arm being fixedly attached at said rear end to a first rotatable shaft, said first rotatable shaft having an outer end and an inner end, and being supported by, and rotatably locked into respective bearings on each of its outer and inner ends, said bearings being located in openings in the top support plates, and being supported by the top support plates, all of the openings in the top support plates, first rotatable shafts, and bearings of both lifting arms, being horizontally aligned from one column to the other, each said lifting arm being detachedly secured near its distal end by a lifting bar common to both lifting arms, to form a U-shaped assembly comprised of the lifting arms and the lifting bar;

the inner ends of each shaft being surmounted by a first large drive sprocket, said first large drive sprocket being connected to a second small drive sprocket by a drive chain for said sprockets, each said second small drive sprocket being fixedly surmounted on a common shaft;

said common shaft having a drive end and a follow end, and being located in the bottom end of the vertical column and being supported by bearings on each of its drive end and follow end, said bearings being located and supported in openings in the bottom support plates, the openings in the bottom support plates, the bearings in the bottom support plates, and the common shaft being horizontally aligned from one column to the other, the following end of the common shaft being rotatably locked into its respective bearing, the driving, end of the common shaft being integrally locked to a transmission located adjacent the common shaft, and being driven by said transmission, which transmission is driven by gears located in a gear box adjacent the transmission, the gear box being driven by a third shaft, which third shaft is driven by a power source, which power source is controlled by a control device mounted on the independent lift near the user thereof;

a support device for supporting a human form, said support device being attached to the lifting bar by two, independent attachment means, each said attachment means being spaced apart along the lifting bar and comprised of (i) a coupling having bearings situated therein, each coupling and bearing surrounding and rotatable around the lifting bar, and (ii) a suspension means, attached to, and extending from each coupling and attached to the support device so as to support, stabilize, and balance the support device;

each said vertical column having a covering which is comprised of a top segment, having an upper surface, and a bottom segment having a top end, each said covering essentially enclosing said vertical column, said top segment being surmounted on the top end of the bottom segment;

each top segment of each covering having a slot through its upper surface, to accommodate a reciprocal movement of each lifting arm therethrough, from the front to the back and from the back to the front of each column, said reciprocal movement of the lifting arms being free through an overhead arc which carries the arms at least below a horizontal plane formed by the horizontal alignment of the first rotatable shafts;

each said slot having inside edges and a groove on its inside edges to accommodate a sliding panel, which sliding panel is a flexible sheet, having a length sufficient to cover the slot in the top of the top segment as the arms travel through the arc from the front to the back and from the back to the front; each sliding panel having an opening near its center to accommodate a lifting arm therethrough; whereby, as each lifting arm is moved, each respective sliding panel is moved in relation thereto, without allowing the slot to be open at anytime;

each said bottom segment being covered by an outward side panel, an inward side panel, a front panel and a back panel, all of which panels are rigidly fixed to the vertical support posts.

5. A lift as claimed in claim 4 in which the lift includes a combination of said power source, third shaft, gears, and transmission in each of the vertical columns and which operate simultaneously.

6. A lift as claimed in claim 5, in which the combination in each vertical column simultaneously drives the lift through said common drive shaft communicating between the vertical columns.

* * * * *